US006253652B1

(12) United States Patent
Dax et al.

(10) Patent No.: US 6,253,652 B1
(45) Date of Patent: Jul. 3, 2001

(54) SLITTER BLADE LOCKING DEVICE

(75) Inventors: James Dax, New London; Jeffrey Knutson, Neenah, both of WI (US)

(73) Assignee: Valmet Corporation, Appleton, WI (US)

( * ) Notice: Subject to any disclaimer, the term of this patent is extended or adjusted under 35 U.S.C. 154(b) by 0 days.

(21) Appl. No.: 09/200,073

(22) Filed: Nov. 25, 1998

(51) Int. Cl.[7] ..... B26D 1/14

(52) U.S. Cl. ..... 83/481; 83/482; 83/499; 83/508.2; 83/508.3; 83/526; 83/563

(58) Field of Search ..... 83/481, 482, 508.2, 83/508.3, 499, 331, 329, 526, 525, 563, 582, 588

(56) References Cited

U.S. PATENT DOCUMENTS 3,892,156 * 7/1975 Johnstone ..... 83/482
4,402,241 9/1983 Moores, Jr. .
4,420,996 12/1983 Greding et al. .
4,474,096 * 10/1984 Muller ..... 83/482
4,540,394 9/1985 Cavagna .
5,025,693 6/1991 Tidland et al. .
5,083,489 1/1992 Tidland et al. .
5,247,865 * 9/1993 Kroger et al. ..... 83/482

* cited by examiner

*Primary Examiner*—M. Rachuba
(74) *Attorney, Agent, or Firm*—Piper Marbury Rudnick & Wolfe

(57) ABSTRACT

In a web slitter of the type used for cutting continuous webs of material, such as paper, a top slitter assembly features a hub cylinder attached to its frame. The hub cylinder supports a freely rotating hub to which the top blade of the web slitter is mounted. The hub cylinder may be raised and lowered with respect to the slitter frame so that the top blade may be lowered to, and raised from, its cutting position. A toggle support is clamped to the hub cylinder while a pin holder is attached to the slitter frame. A toggle is attached to the toggle support in a pivoting fashion. Housed within the pin holder is a sliding pin and a compression spring. The compression spring resists the movement of the pin towards the hub of the web slitter. The pin may be extended so that it engages a notch in the hub. When the hub cylinder is raised, the toggle may be pivoted so that it abuts the end of the engaged pin against the action of the compression spring. As a result, the pin is maintained in engagement with the hub. This causes the hub, and thus the blade, of the slitter to be locked against rotation. An operator may pivot the toggle back to its original position to unlock the hub and blade. If the blade is lowered into the cutting position with the pin still engaged, the toggle is pulled off of the pin so that the blade is automatically unlocked.

19 Claims, 5 Drawing Sheets

SLITTER BLADE LOCKING DEVICE

BACKGROUND OF THE INVENTION

The invention relates generally to web slitter machines of the type used for cutting a continuous web of material and, more particularly, to a device for locking the blades of such machines to facilitate maintenance and blade replacement.

Web slitters are cutting machines commonly employed to cut an endless web, such as a continuous roll of paper, to reduce the initial wide web into a series of narrower webs during winding or rewinding operations. A typical prior art web slitter for use in paper manufacturing is indicated generally at 8 in FIG. 1. Such web slitters are manufactured by the Valmet Corporation of Helsinki, Finland. As is shown in FIG. 1, the web slitter 8 includes a top blade 10 in the form of a rotary cutting disk that is suspended from a slitter frame 9 which is attached to one or more transverse bars 11 by an intermediate slitter carriage 17. An operator locks slitter frame 9 in position on slitter carriage 17 by manipulating handles 15. The slitter frame 9 and the components mounted thereon, including top blade 10, make up what is known as the top slitter assembly. The web slitter 8 also includes a bottom band 12 that is rotated by a motor 13.

During operation, top blade 10 is positioned or "side loaded" so that it lightly engages the side edge of bottom band 12. The leading point of contact between top blade 10 and bottom band 12 forms a cutpoint whereby the paper web is cut. As a result, top blade 10 and bottom band 12 overlap to provide a scissors-like action for cutting the web as it unwinds from a roll and is pulled through the web slitter by a take-up roll. A plurality of web slitters may be connected to create parallel paper strips of various widths.

After a period of use, top blade 10 becomes dull and requires replacement. In order to "change-out" the top blade 10, the operator first raises the top blade 10 away from bottom band 12, as illustrated in FIG. 1. The top blade 10 is secured to the hub 14 of slitter 8 by a locking ring 16. In order to remove locking ring 16, the operator first loosens the clamping screw 20. Then, a locking ring removal/locking tool is used to free the hub 14. Locking ring 16 then may then be unscrewed by hand from hub 14. Once locking ring 16 is removed from hub 14, as illustrated in FIG. 2, the operator may remove top blade 10.

Once the new blade is positioned on hub 14, the reverse procedure is performed to complete the blade change-out process.

Currently, paper mill operations people frequently find it difficult to complete a blade change-out using the above procedure. More specifically, an operator is required to use two hands when using the locking ring removal/locking tool. One hand is used to hold the tool in engagement with the locking ring while the other hand is used to turn or apply leverage to the tool. However, the tool does not prevent the hub from rotating. The operator is thus required to hold the blade so that it doesn't turn while operating the tool. As a result, the operator must steady both the tool and blade with one hand while simultaneously turning the tool with the other hand. This task can be both difficult and time consuming.

In the operation of high speed machinery, such as in paper manufacturing, the cost of machine downtime can be very high. As a result, it is desirable to minimize the time that it takes to perform maintenance operations. One way to minimize machine downtime is to reduce the time necessary to perform blade change-outs. If a web slitter was equipped with mechanisms to prevent the blade 10 from rotating during a blade change-out, operators could perform the task more quickly and safely. As a result, it is desirable to provide web slitters that may be locked to prevent rotating during blade change-outs and other maintenance procedures.

Previous blade locking mechanisms, such as those provided by the Economy Machine and Tool Company of Green Bay, Wis. have utilized a pin with a cable attached. The operation of such mechanisms involve inserting the pin through aligned holes in the hub and slitter frame. As a result, the hub and top blade are prevented from rotating. A disadvantage of this arrangement, however, is that should the pin be left engaged when the top blade is lowered and/or used for slitting, severe damage to the slitter and injury to the worker could result. In addition, lost production could occur due to an uncut or random cut paper roll.

Another type of locking mechanism involves the use of a spring plunger that engages a hole in the hub when the plunger is extended. Such mechanisms are available from the Tidland Corporation of Camas, Wash. and the Diennes Corporation of Spencer, Mass. The operator must hold the plunger in engagement with the hole in the hub, however. As a result, this mechanism does not free up both of the operator's hands.

Accordingly, it is an object of the present invention to provide a device and method for locking a slitter blade so that an operator may use both hands to perform blade change-outs and other maintenance.

It is another object of the present invention to provide a device and method for locking a slitter blade so that blade change-outs and maintenance may be performed more rapidly and safely.

It is another object of the present invention to provide a device and method for locking a slitter blade whereby the blade is automatically unlocked when the blade is engaged for slitting.

It is another object of the present invention to provide a device and method for locking a slitter blade that is simple to manufacture and easy to use.

It is still another object of the present invention to provide a device and method for locking a slitter blade that may be used with existing web slitters.

SUMMARY OF THE INVENTION

The present invention is directed to a device for locking the radial top blade of a web slitter against rotation. A typical web slitter features a top slitter assembly that includes a slitter frame to which a hub cylinder is mounted. The hub cylinder is mounted so that it may be raised or lowered with respect to the frame. A hub is disposed in the hub cylinder so that it may freely rotate therein. The top blade of the web slitter is mounted to the hub.

The locking device of the present invention features a toggle support that is clamped to the hub cylinder of the web slitter. A toggle is attached to the toggle support by a shaft so that it may pivot. A pin holder is attached to the frame of the web slitter with screws. The pin holder is positioned adjacent to the hub of the web slitter and contains a sliding pin. The pin holder also houses a compression spring that biases the pin away from the hub of the web slitter. The hub features a notch that is sized to receive one end of the pin.

When the top blade of the slitter requires replacement, the hub cylinder is raised. Raising the hub cylinder causes the toggle support to be positioned in the vicinity of the pin holder. Next, the notch of the hub is horizontally aligned with the sliding pin within the pin holder. The sliding pin is then inserted into the notch and the togale is pivoted so that one end of the pin is abutted thereby against the action of the compression spring. As a result, the pin is secured in engagement with the notch of the hub so that the hub of the slitter, and thus the top blade, are prevented from rotating. An operator may release the sliding pin from its engaged position by pivoting the toggle back to its original position. Alternatively, due to the positioning of the toggle support on the hub cylinder and the pin holder on the frame, the toggle is removed from abutment with the sliding pin, and thus the blade is automatically unlocked, when the blade is lowered into the cutting position.

DESCRIPTION OF THE PREFERRED EMBODIMENTS

Figure 1:
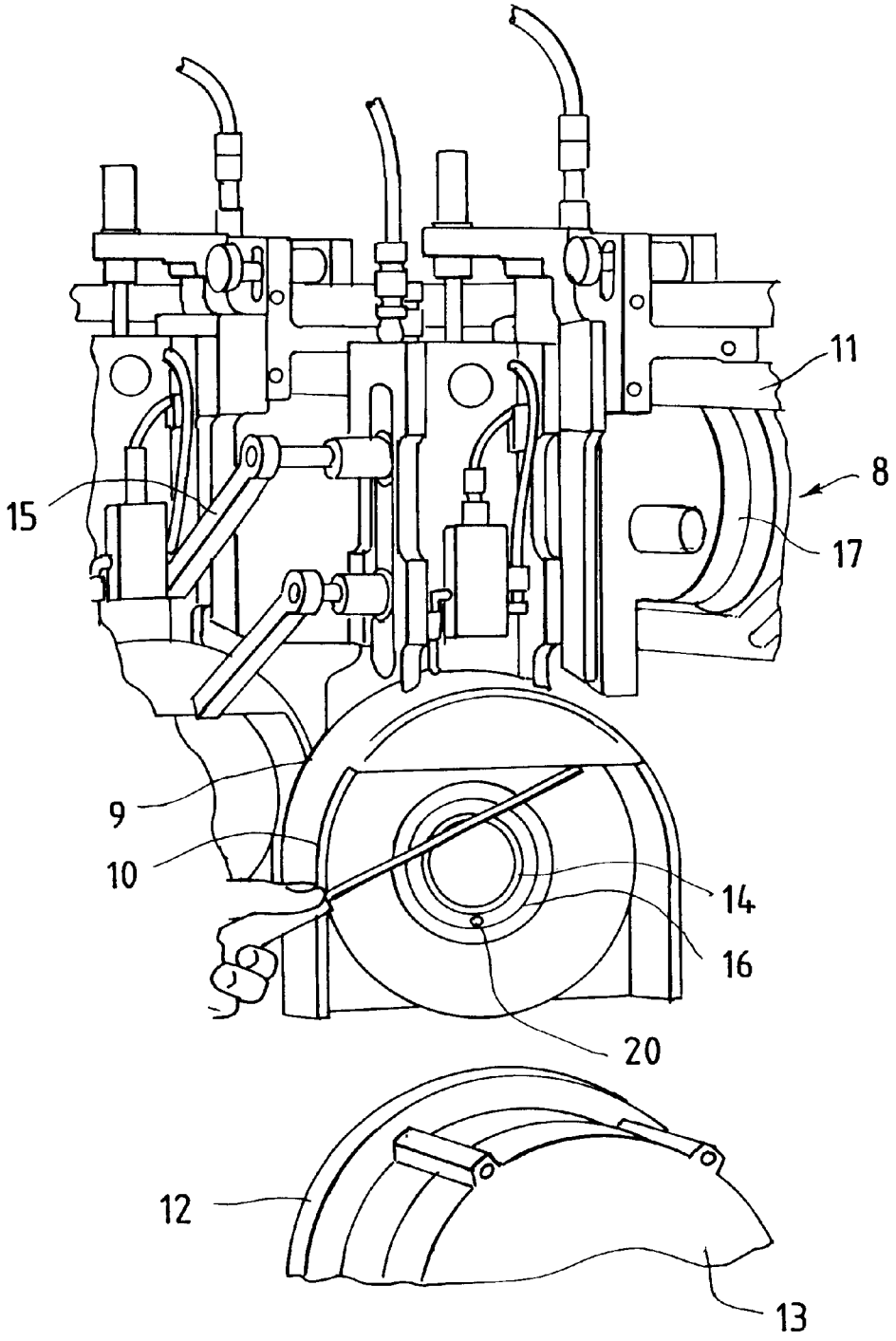
FIG. 1 PRIOR ART
FIGS. 1 is a perspective view of a prior art web slitter of the type suitable for use with the present invention.
Figure 2:
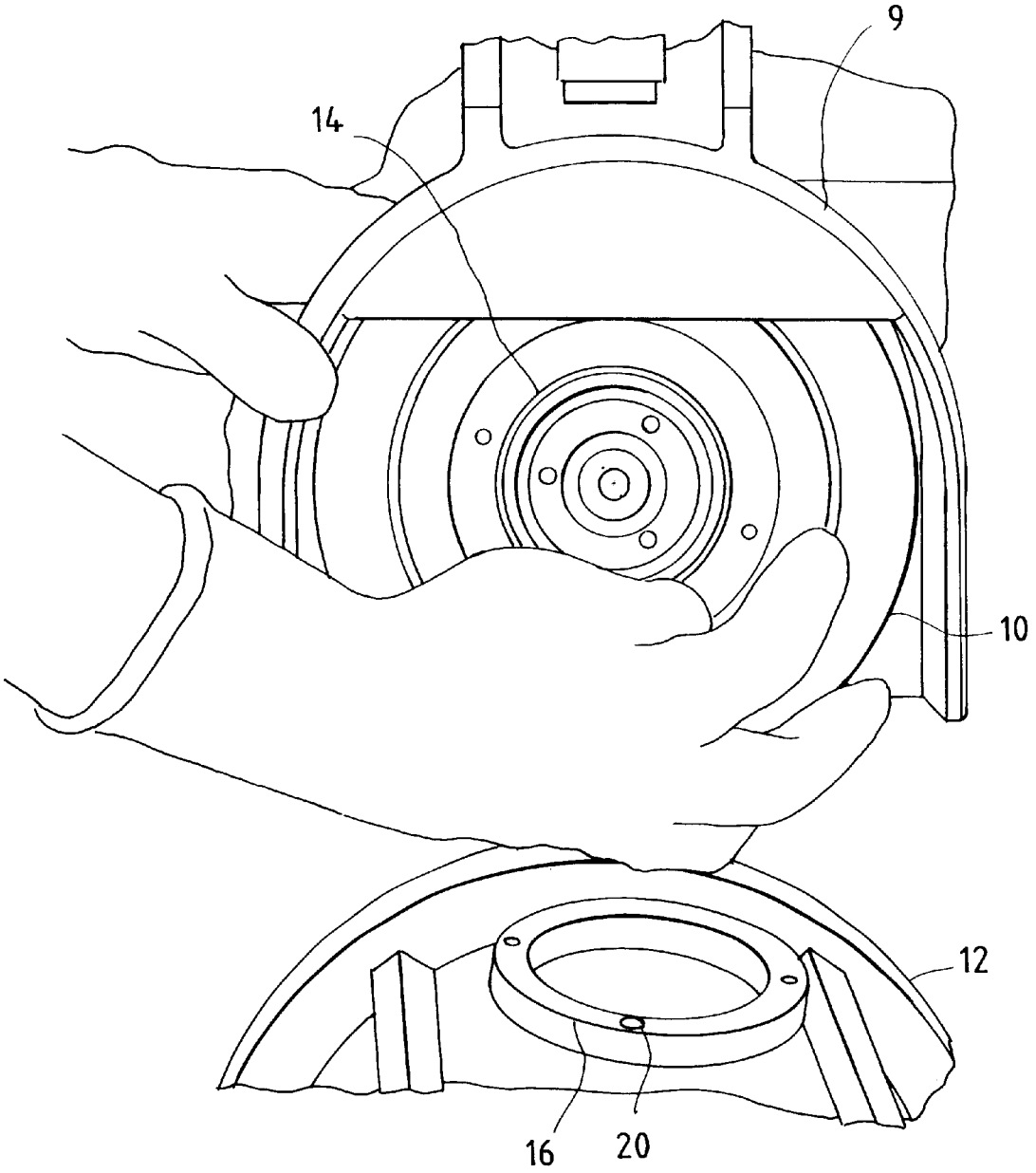
FIG. 2 PRIOR ART
FIG. 2 is an enlarged view of the web slitter of FIG. 1 illustrating a portion of the blade changeout procedure.
Figure 3:
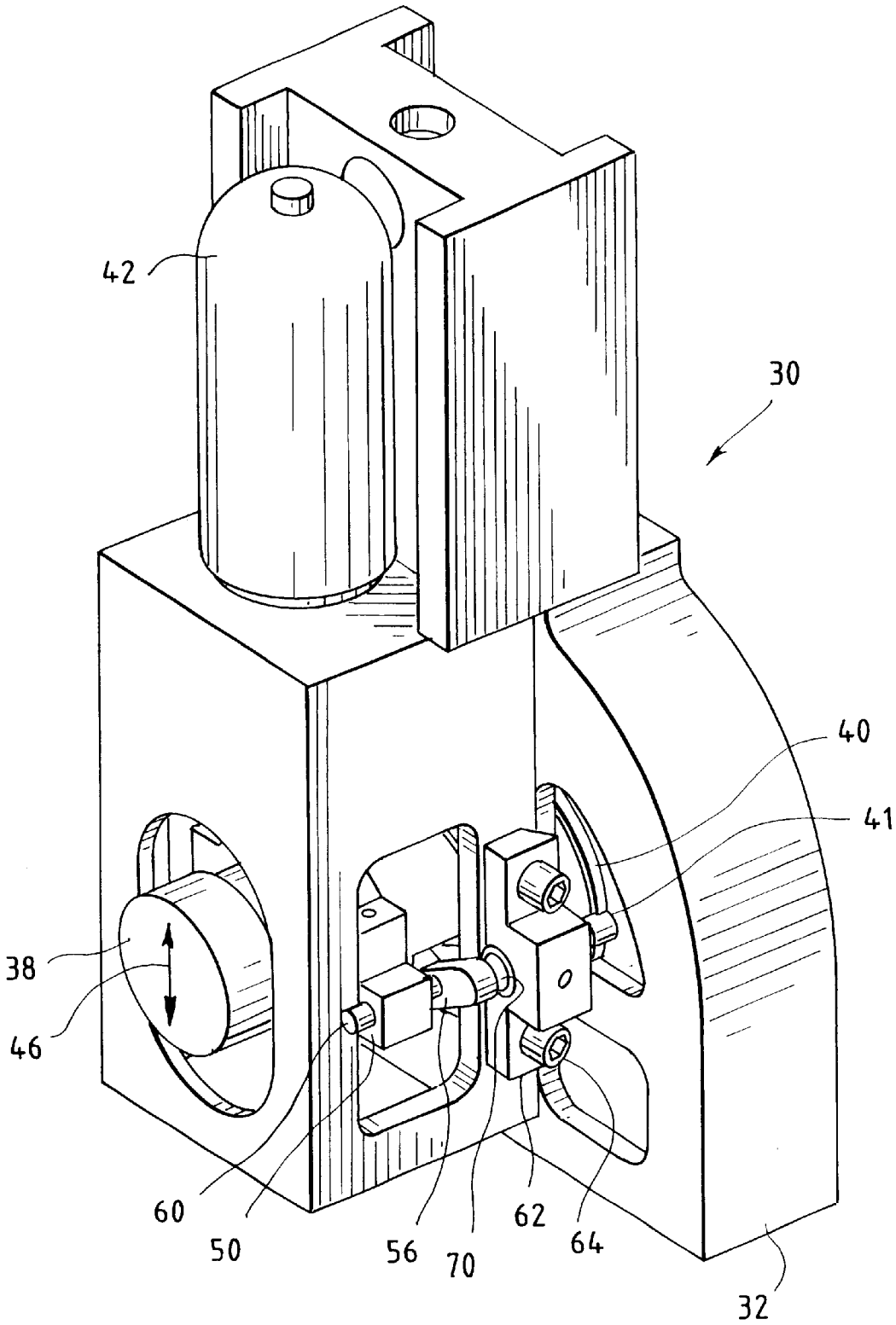
FIG. 3 is a right front perspective view of the top slitter assembly of a web slitter equipped with the locking device of the present invention.

Referring to FIG. 3, the top slitter assembly of a web slitter equipped with the locking device of the present invention is indicated generally at 30. The top slitter assembly is suspended from one or more overhead transverse bars (11 in FIG. 1) by an intermediate slitter carriage (17 in FIG. 1). The slitter frame, indicated at 32, is attached to the intermediated slitter carriage.

Figure 6:
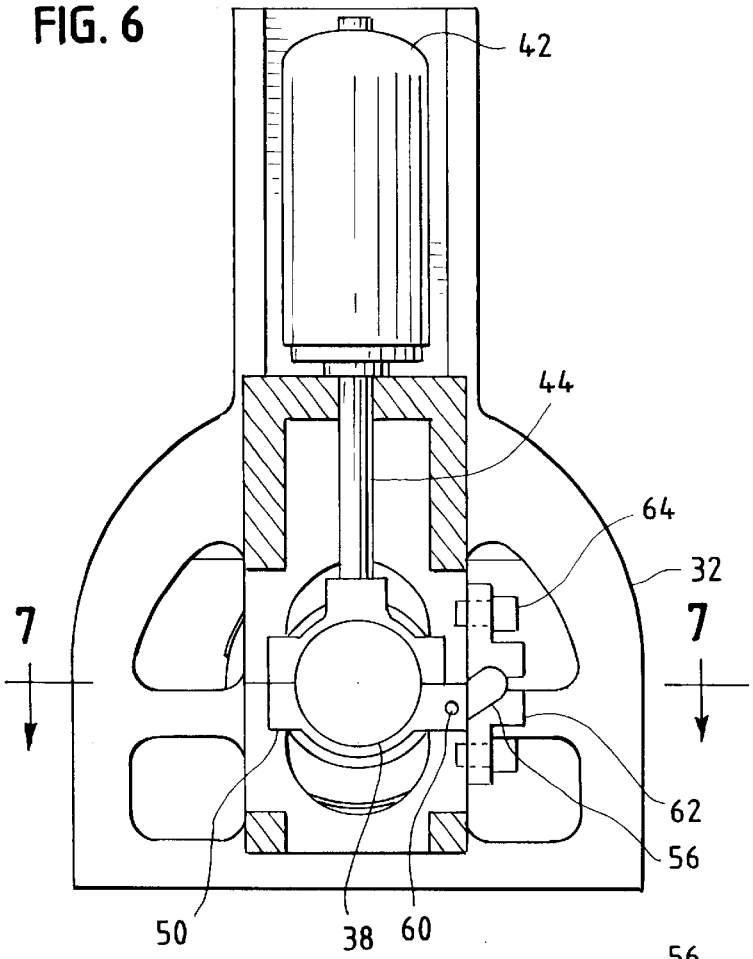
FIG. 6 is a sectional view of the top slitter assembly of FIG. 3 taken along line 6—6 of FIG. 7.

As shown in FIG. 3, positioned within slitter frame 32 is a hub cylinder 38. Hub cylinder 38 contains bearings (not shown) so that a hub 40 is able to freely rotate therein. A radial cutting blade (such as the one indicated at 10 in FIG. 1) is secured to hub 40 when the web slitter is in operation. Hub 40 features a notch 41 in its edge. A pneumatic cylinder 42 is mounted to frame 32 and is linked via rod 44 (FIG. 6) to hub cylinder 38 so that the latter may be raised and lowered as indicated by arrow 46 (FIG. 3).

Figure 4:
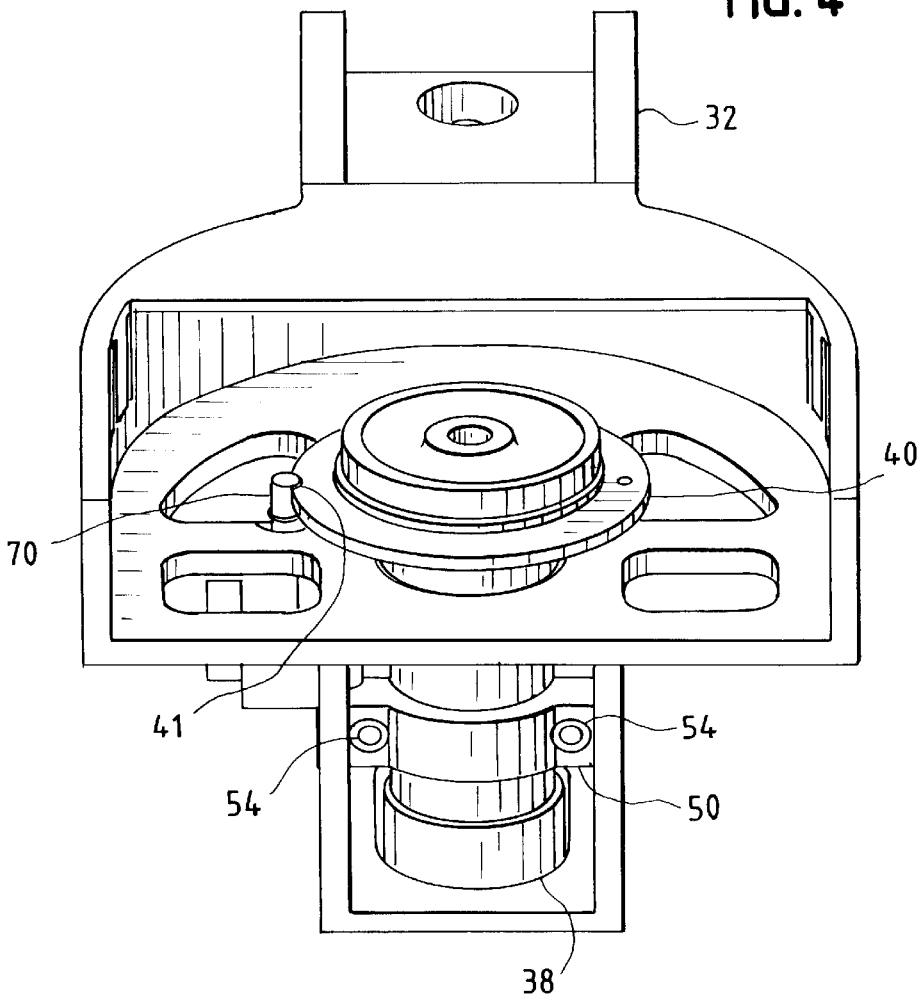
FIG. 4 is a bottom perspective view of the top slitter assembly of FIG. 3.
Figure 5A:
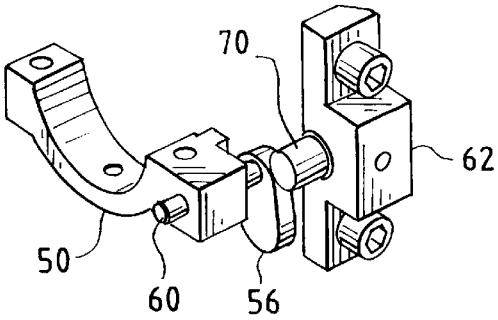
FIGS. 5A and 5B are enlarged perspective views of the locking device of the present invention in its unlocked and locked configurations, respectively.
Figure 5B:
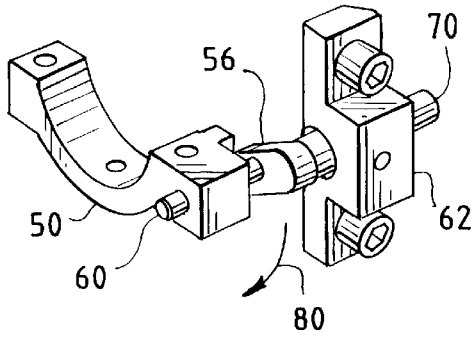

As illustrated in FIG. 4, a toggle support 50 is clamped to hub cylinder 38 via bolts 54. As a result, toggle support 50 is secured to hub cylinder 38 so as to travel up and down therewith. As shown in FIGS. 5A and 5B, a toggle 56 is attached to toggle support 50 in a pivoting fashion by shaft 60. The function of toggle 56 will be explained below. It should be noted that while a cam-shaped toggle is illustrated, toggle 56 may feature a variety of alternative shapes and geometries.

Figure 7:
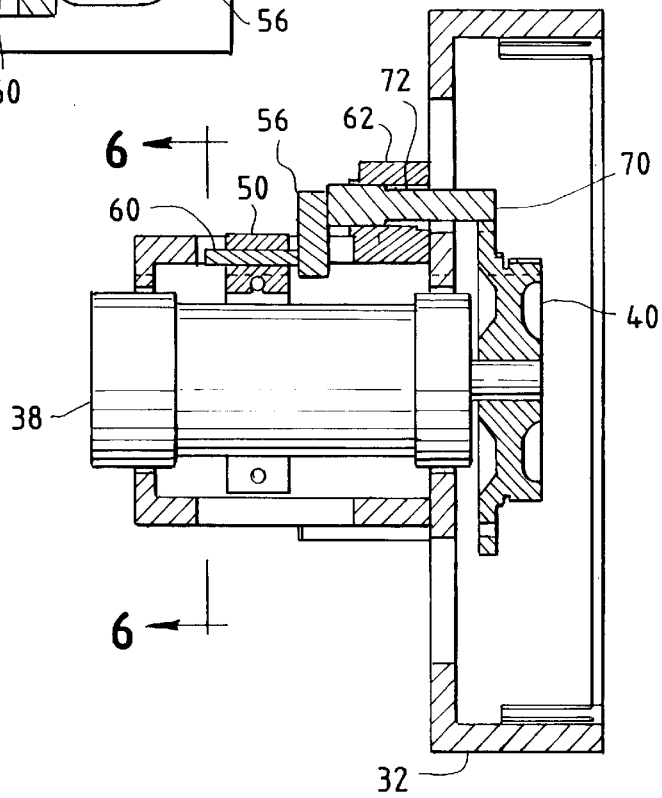
FIG. 7 is a sectional view of the top slitter assembly of FIG. 3 taken along line 7—7 of FIG. 6.

Referring to FIG. 3, a pin holder 62 is secured to frame 32 by allen screws 64. As shown by FIGS. 5A and 5B, a pin 70 is slidingly mounted within pin holder 62. As shown in FIG. 7, a compression coil spring 72 is also mounted within pin holder 62 so as to urge pin 70 in a direction away from hub 40. A set screw 76 may be used to retain the pin 70 and spring 72 within the pin holder 62. Pin 70 is sized so that it is able to engage the notch 41 of hub 40, as best illustrated in FIG. 4. It should be noted that while a compression coil spring is preferred and illustrated, spring 72 may take many alternative forms.

The operation of the above components will now be explained. When a blade change-out for the web slitter becomes necessary, the hub cylinder 38 is elevated from a cutting position to a maintenance position shown in FIG. 3 so that the pin 70 and toggle 56 are oriented as shown in FIG. 5A. The operator then aligns the notch 41 of hub 40 with pin 70 (shown most clearly in FIG. 4). The operator then depresses pin 70 so that it extends and engages notch 41 against the action of compression spring 72 (FIG. 7). The operator then pivots toggle 56 so that it secures pin 70 in the blocking position. The action of compression spring 72 holds the end of pin 70 against the toggle 56, as shown in FIG. 5B. As a result, hub 40, and thus the top blade of the web slitter, is locked against rotation. The operator then has both hands free so that he or she may easily proceed with the blade change-out.

When the operator has completed the blade change-out, toggle 56 is manually pivoted in a clockwise direction, as indicated by arrow 80 in FIG. 5B. As a result, the pin 70 snaps back to its original position, illustrated in FIG. 5A, so that the hub and top blade are again unlocked and free to rotate. The operator may then lower the cylinder hub 38 into the cutting position.

Should the operator forget to release toggle 56 from pin 70, the downward travel of hub cylinder 38 will automatically free pin 70 from toggle 56 so that the pin 70 snaps back to its original position illustrated in FIG. 5A. In this way, the device of the present invention avoids accidental blade lockouts that could potentially result in machine damage, operator injury or lost productivity and resources.

It is to be noted that virtually any similarly constructed web slitter may be retrofitted to include the locking device of the present invention. All that is required is that the pieces shown in FIGS. 5A and 5B be attached to the slitter frame 32 and hub cylinder 38 and that an appropriately-sized notch 41 be added to the hub 40.

Pin holder 62, pin 70, toggle support 50 and toggle 56 are all preferably constructed from a hard, durable material such as metal. The ease of assembly and simple installation of the locking device of the present invention make it inexpensive to manufacture and implement. As a result, the locking device of the present invention offers a cost-effective way to minimize machine down-time and maximize protection of the operator and the machinery during blade change-outs and maintenance.

While the preferred embodiments of the invention have been shown and described, it will be apparent to those skilled in the art that changes and modifications may be made therein without departing from the spirit of the invention, the scope of which is defined by the appended claims.

What is claimed is:

1. A device for locking a blade of a web slitter to prevent rotation of the blade during maintenance, said blade being mounted to a hub (40), the device comprising:

a) a pin holder (62) mounted to the web slitter;

b) a pin (70) slidingly disposed within said pin holder for movement between extended and retracted positions, said pin including a first end and a second end, the first end of said pin engaging said hub when in the extended position;

c) a toggle pivotally mounted to the web slitter, said toggle engaging the second end of said pin to secure the pin in the extended position; and d) said pin returning to the retracted position when the toggle is disengaged from the second end of said pin.

2. The device of claim 1 further comprising a spring (72) disposed within said pin holder (62) to bias the pin (70) towards its retracted position.

3. The device of claim 2 further comprising means for raising and lowering (42, 44) a hub cylinder (38) between a raised maintenance position and a lowered cutting position;

whereby said toggle (56) automatically release said pin (70) to disengage a notch (41) in the hub (40) when the hub cylinder is lowered into the cutting position.

4. The device of claim 3 further comprising a toggle support (50) that is attached to the hub cylinder (38), said toggle pivotally connected to said toggle support.

5. The device of claim 4 wherein the toggle support is clamped to the hub cylinder.

6. The device of claim 4 wherein the toggle is pivotally attached to the toggle support by a shaft (60).

7. In a web slitter having a hub supporting a radial blade, a hub cylinder within which the hub is rotatingly disposed, a frame upon which the hub cylinder is disposed and means for raising and lowering the hub cylinder with respect to the frame between a raised maintenance position and a lowered cutting position, a device for locking the blade against rotation to permit maintenance comprising:

a) a pin holder (62) attached to the frame (32);

b) a pin (70) having a first end and a second end, said pin slidingly disposed within said pin holder so that when the first end of the pin is pressed, the second end extends to engage a notch (41) in the hub (40) when the hub cylinder is in the raised maintenance position; and c) a toggle (56) which may be pivoted to abut the first end of said pin to secure the second end of said pin in engagement with the notch when the hub cylinder is in the raised maintenance position.

8. The device of claim 7 further comprising a spring (72) disposed within said pin holder (62) to bias the pin (70) away from the hub (40);

whereby said toggle (56) is automatically freed from said pin (70) so that the pin disengages the notch (41) in the hub (40) under the action of the spring (72) when the hub cylinder is lowered into the cutting position.

9. The device of claim 7 further comprising a toggle support (50) attached to the hub cylinder (38), said toggle pivotally attached to said toggle support.

10. The device of claim 9 wherein the toggle support is clamped to the hub cylinder.

11. The device of claim 9 wherein the toggle is pivotally attached to the toggle support by a shaft (60).

12. A device for locking a blade of a web slitter against rotation for maintenance purposes, the blade being mounted to a hub, the hub being supported by a hub cylinder for rotational and translational movement relative to a frame, the device comprising:

a) a toggle support (50) attached to the hub cylinder (38);

b) a pin holder (62) attached to the frame (32);

c) a pin (70) slidingly disposed within said pin holder for movement between an extended position and a retracted position, said pin including a first end and a second end, said first end of said pin engaging said hub when in the extended position;

d) said pin holder positioned on said frame so that when said pin is in the extended position, and said hub cylinder is in a raised maintenance position, said pin engages a notch (41) in the hub (40) to prevent the blade from rotating; and e) a toggle (56) pivotally connected to said toggle support so that the toggle is pivotable to engage said second end of said pin to secure the pin in the extended position.

13. The device of claim 12 further comprising a spring (72) disposed within said pin holder (62) to bias the pin (70) away from the hub (40).

14. The device of claim 13 further comprising means for raising and lowering (42,44) the hub cylinder (38) between the raised maintenance position and a lowered cutting position;

whereby said toggle (56) is automatically freed from pin (70) so that the pin disengages the notch (41) in the hub (40) under the action of the spring (72) when the hub cylinder is lowered into the cutting position.

15. The device of claim 12 wherein the toggle support is clamped to the hub cylinder.

16. The device of claim 12 where the toggle is pivotally attached to the toggle support by a shaft (60).

17. The device of claim 4, wherein the notch is disposed on an outer edge of the hub.

18. The device of claim 14, wherein the toggle pivots independently of the pin.

19. The device of claim 4, wherein the pin is disposed within the pin holder such that it slides linearly between extended and retracted positions.

* * * * *